US007628297B2

(12) United States Patent
Pugne

(10) Patent No.: US 7,628,297 B2
(45) Date of Patent: Dec. 8, 2009

(54) DISPENSING CLOSURE, PACKAGE AND METHOD OF MANUFACTURE

(75) Inventor: Darin M. Pugne, Perrysburg, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 388 days.

(21) Appl. No.: 11/190,443

(22) Filed: Jul. 27, 2005

(65) Prior Publication Data

US 2007/0023462 A1 Feb. 1, 2007

(51) Int. Cl.
*B65D 47/00* (2006.01)

(52) U.S. Cl. ..... 222/556; 220/254.3; 215/237

(58) Field of Classification Search ..... 222/556, 222/494, 546, 557, 498, 499, 516, 517, 561; 220/254.1–254.7, 259.1, 300, 833, 834, 805, 220/841, 324; 215/224, 245, 237
See application file for complete search history.

(56) References Cited

U.S. PATENT DOCUMENTS

| | | | | |
|---|---|---|---|---|
| 3,362,591 | A | 1/1968 | Latham et al. | |
| RE29,793 | E | 10/1978 | Pehr | |
| 4,457,458 | A * | 7/1984 | Heinol | 222/498 |
| 4,533,058 | A * | 8/1985 | Uhlig | 215/216 |
| D292,889 | S | 11/1987 | Ostrowsky | |
| 4,749,108 | A | 6/1988 | Dornsbusch et al. | |
| 5,203,467 | A * | 4/1993 | Tucker | 220/254.3 |
| 5,271,531 | A * | 12/1993 | Rohr et al. | 222/212 |
| D355,121 | S | 2/1995 | Kohl | |
| 5,390,805 | A * | 2/1995 | Bilani et al. | 215/260 |
| 5,579,957 | A | 12/1996 | Gentile et al. | |
| 5,632,420 | A * | 5/1997 | Lohrman et al. | 222/212 |
| 5,769,253 | A * | 6/1998 | Gross | 215/237 |
| 5,865,354 | A * | 2/1999 | Bansal | 222/546 |
| 5,897,033 | A | 4/1999 | Okawa et al. | |
| 6,089,411 | A | 7/2000 | Baudin et al. | |
| 6,357,625 | B2 * | 3/2002 | Kimble et al. | 222/1 |
| D542,132 | S * | 5/2007 | Pugne | D9/449 |
| 2003/0106910 | A1 | 6/2003 | Hicks et al. | |
| 2005/0109782 | A1 * | 5/2005 | Biesecker et al. | 220/259.1 |
| 2006/0186077 | A1 * | 8/2006 | Robinson | 215/237 |

* cited by examiner

*Primary Examiner*—Lien T Ngo
(74) *Attorney, Agent, or Firm*—Reising Ethington PC

(57) ABSTRACT

A dispensing closure includes a closure shell of one-piece integrally molded plastic construction having a base for securement to a container neck finish and a lid coupled by a hinge to the base. The base has a deck, a recess extending across the deck from a point adjacent to the hinge, and a dispensing opening in the recess. The lid has a base portion for receipt in the recess in the closed position of the lid and a tongue at an end of the lid remote from the hinge. A latch on the base in the recess engages the tongue on the lid releasably to hold the lid in the closed position. The latch preferably comprises a snap latch that includes an internal bead on the tongue and an external latch element in the recess over which the internal bead is received in the closed position of the lid. The base preferably includes a ledge in the recess against which the tongue abuts, and a pair of ribs for frictionally holding the tongue against the body.

31 Claims, 3 Drawing Sheets

DISPENSING CLOSURE, PACKAGE AND METHOD OF MANUFACTURE

The present disclosure is directed to dispensing closures for fluid products such as beverages, food condiments and body lotions, to dispensing packages that include such closures, and to methods of making such closures.

BACKGROUND AND SUMMARY OF THE DISCLOSURE

Fluid dispensing closures typically include a one-piece integrally molded shell having a base and a lid connected by a hinge to the base to pivot between a closed position adjacent to the base and an open position spaced from the base. The base includes a dispensing opening through which product may be dispensed in the open position of the lid, and through which dispensing is blocked in the closed position of the lid. U.S. Pat. Nos. 6,766,926 and 6,880,736 illustrate dispensing closures of this type. It is a general object of the present disclosure to provide a dispensing closure, a dispensing closure and container package, and a method of making a dispensing closure, in which the lid is disposed within a recess in the base and releasably secured to the base in the closed position of the lid, and/or in which a dispensing valve is disposed within the dispensing opening in the base and the lid is structured to prevent inward opening of the valve as the lid is closed.

The present disclosure embodies a number of aspects that may be implemented separately from or in combination with each other.

A dispensing closure in accordance with one aspect of the present disclosure includes a closure shell of one-piece integrally molded plastic construction having a base for securement to a container neck finish and a lid coupled by a hinge to the base. The base has a deck, a recess extending across the deck from a point adjacent to the hinge, and a dispensing opening in the recess. The lid has a base portion for receipt in the recess in the closed position of the lid and a tongue at an end of the lid remote from the hinge. A latch on the base in the recess engages the tongue on the lid releasably to hold the lid in the closed position. The latch preferably comprises a snap latch that includes an internal bead on the tongue and an external latch element in the recess over which the internal bead is received in the closed position of the lid. The base preferably includes a ledge in the recess against which the tongue abuts, and a pair of ribs for frictionally holding the tongue against the body.

A dispensing closure in accordance with another aspect of the present disclosure includes a closure shell of one-piece integrally molded plastic construction having a base for securement to a container neck finish and a lid coupled by a hinge to the base. The base has a deck and a skirt, a deck recess extending across the deck from a point adjacent to the hinge, a dispensing opening in the deck recess, and a thumb recess in the skirt that opens into the deck recess at a position opposite from the hinge. The lid has a periphery for receipt in the deck recess in the closed position of the lid and a tongue at an edge of the lid remote from the hinge. A pair of ribs in the thumb recess frictionally engage the tongue, between the ribs and the deck, in the closed position of the lid. The tongue preferably has an internal rib and the deck preferably has an external latch element in the thumb recess for snap-receipt of the internal rib in the closed position of the lid. The deck recess and the lid preferably have laterally spaced side edges that converge between the hinge and the thumb recess. A dispensing valve optionally may be provided in the dispensing opening.

A dispensing closure in accordance with a further aspect of the present disclosure includes a closure shell of one-piece integrally molded plastic construction having a base for securement to a container neck finish and a lid coupled by a hinge to the base. The base has a deck with a dispensing opening and an elastomeric dispensing valve disposed within the dispensing opening. The lid has a wall disposed and contoured for receipt within the dispensing opening between the valve and an inner periphery of the dispensing opening to prevent opening of the valve when the lid is closed. The wall has at least one external channel for venting air when the lid is closed. The at least one channel preferably comprises a circumferential array of channels disposed around the outer periphery of the wall.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
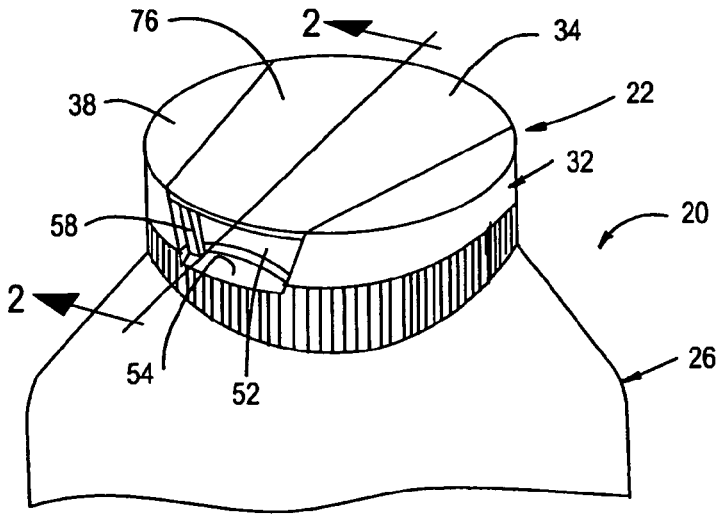
FIG. 1 is a fragmentary perspective view of a package in accordance with an exemplary embodiment of the present disclosure.
Figure 2:
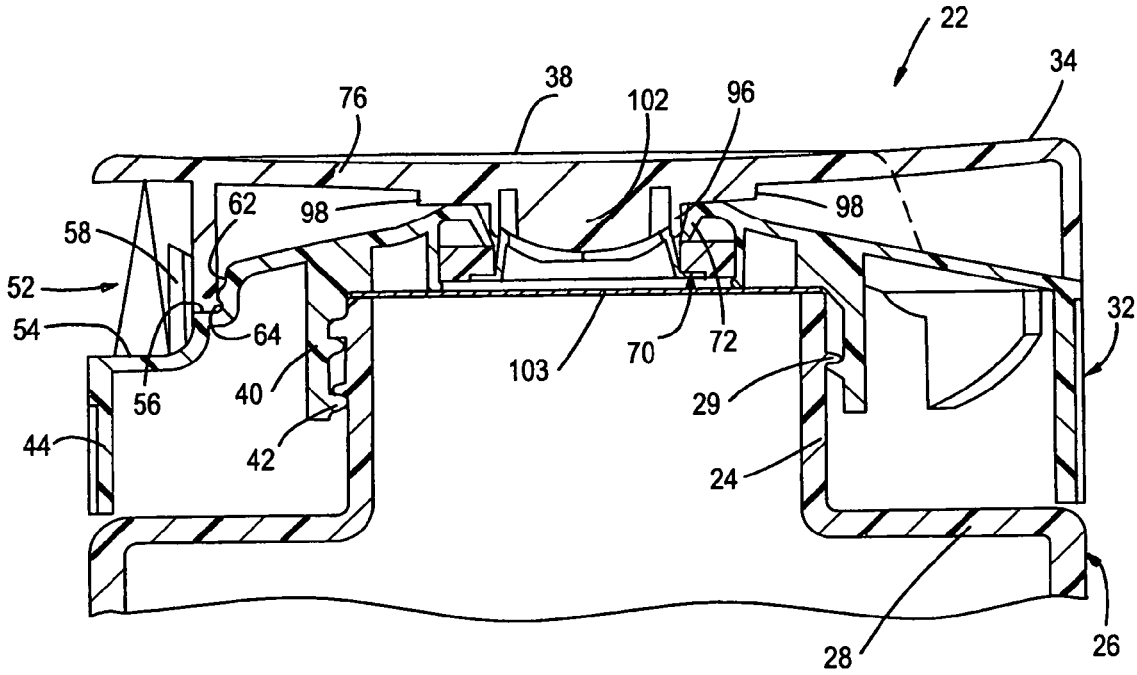
FIG. 2 is a fragmentary sectional view taken substantially along the line 2-2 in FIG. 1.
Figure 3:
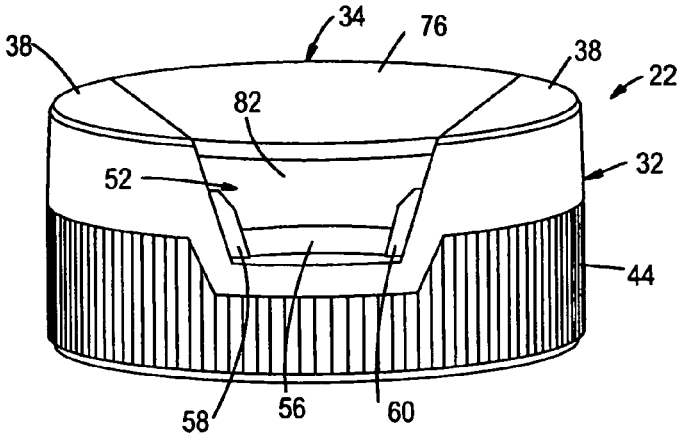
FIG. 3 is a front perspective view of the dispensing closure in the package of FIGS. 1 and 2 with the lid closed.
Figure 4:
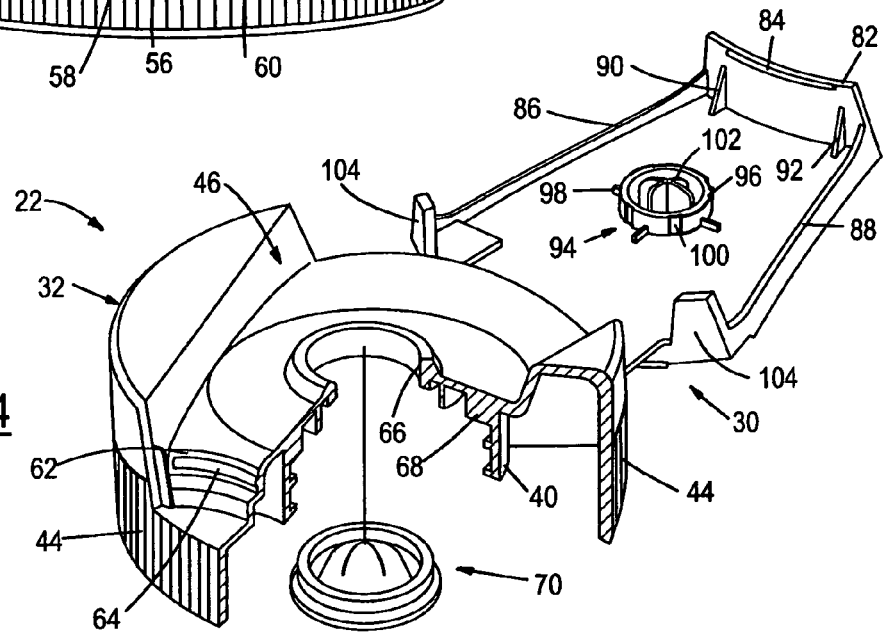
FIG. 4 is a partially sectioned exploded perspective view of the dispensing closure in the exemplary embodiment of FIGS. 1-3.

FIGS. 1-2 illustrate a package 20 in accordance with an exemplary embodiment of the disclosure as including a dispensing closure 22 applied to the neck finish 24 of a container 26. Container 26 has a body 28 that may be integral with or made separately from neck finish 24. Neck finish 24 typically may be of cylindrical geometry and have one or more external beads or thread segments 29 by means of which closure 22 is secured to neck finish 24. (The term "thread segment" is used in its usual broad sense to include both complete and partial threads, and both continuous and interrupted threads.) Container 26, including neck finish 24 and body 28, preferably is of integrally molded plastic construction, with the container body being resiliently squeezable to dispense product through the dispensing closure.

Dispensing closure 22 includes a shell 30 (FIGS. 4-8) of one-piece integrally molded plastic construction. Shell 30 in the illustrated exemplary embodiment of the disclosure includes a base 32 to which a lid 34 is coupled by a hinge 36. Hinge 36 may comprise one or more hinge elements. The specific hinge 36 illustrated in the drawings is a snap hinge of the type disclosed in U.S. Pat. No. 6,041,477, although other hinge constructions can be employed. Base 32 in the exemplary embodiment of the disclosure includes a deck 38 from which an inner skirt 40 depends. Inner skirt 40 has suitable internal beads or thread segments 42 for securement to external beads or thread segments 29 on container neck finish 24 to secure closure 22 to container 26. An outer peripheral skirt 44 extends from deck 38, and preferably is contoured in coordination with the contour of the container 26 to which closure 22 is to be secured. Outer skirt 44 in the exemplary embodiment of the disclosure is substantially cylindrical. Outer skirt may be coaxial with inner skirt 40 as in the exemplary embodiment, or may be offset from the axis of the inner skirt.

Figure 5:
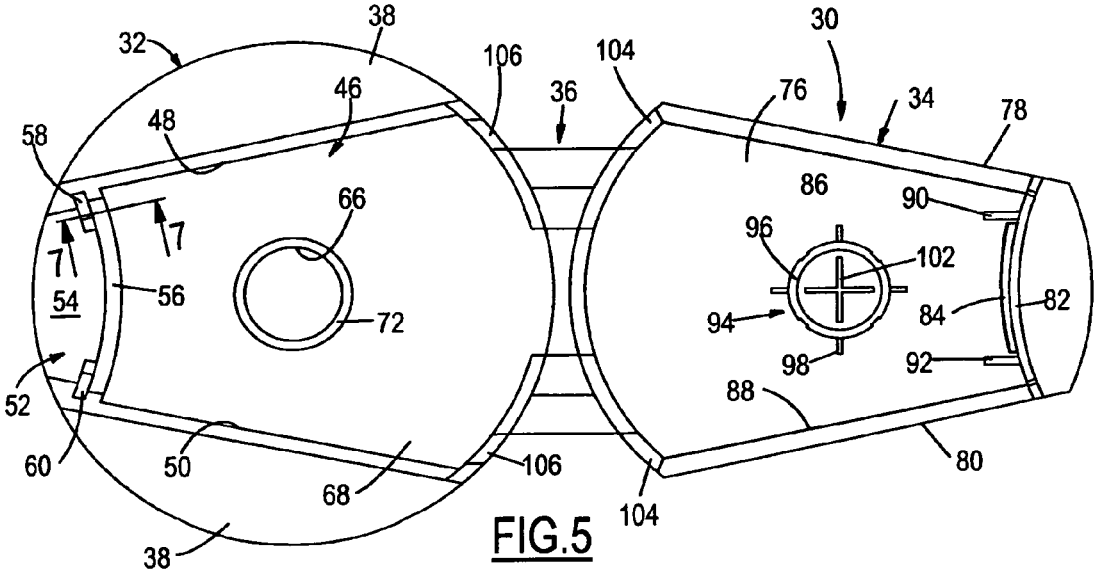
FIG. 5 is a top plan view of the closure shell in the closure of FIGS. 1-4.
Figure 6:
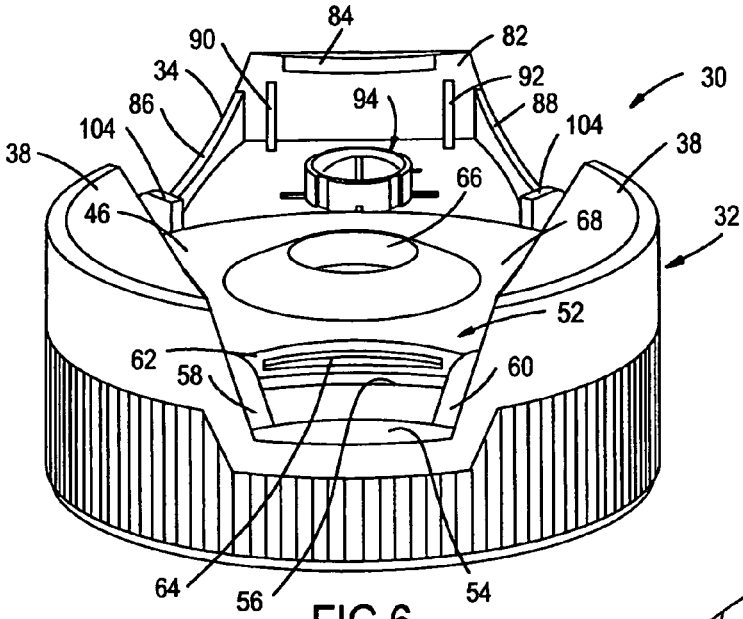
FIG. 6 is a front perspective view of the closure shell in FIG. 5.
Figure 7:
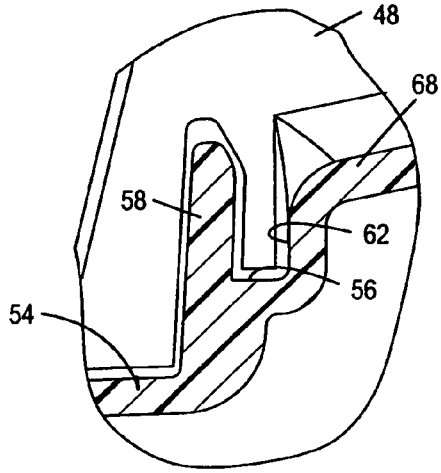
FIG. 7 is a fragmentary sectional view taken substantially along the line 7-7 in FIG. 5.
Figure 8:
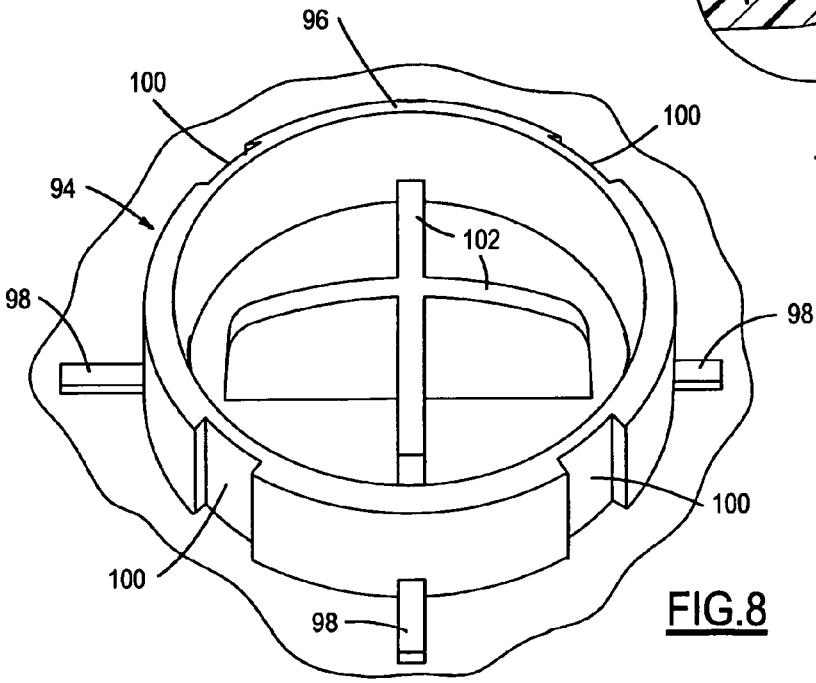
FIG. 8 is a fragmentary perspective view on an enlarged scale of a portion of the dispensing closure shell in FIGS. 5-6.

A recess 46 is provided in deck 38 extending from hinge 36 to a position on base 32 opposite from hinge 36. In the illustrated exemplary embodiment of the disclosure, recess 46 has a pair of laterally spaced walls 48, 50 that are straight and converge toward each other from hinge 36 to the opposite side of base 32. A thumb recess 52 in skirt 44 opens onto the end of deck recess 46 opposite from hinge 36 and extends between the opposed surfaces of recess sidewalls 48, 50. Thumb recess 52 has an axially facing bottom wall 54, which preferably is substantially flat and is downwardly or axially spaced from the adjacent edge of deck recess 46. A step or ledge 56 is provided between wall 54 and the adjacent edge of deck recess 46. The upper or axially facing surface of ledge 56 is arcuate as viewed from the axial direction in FIG. 5. (Directional words such as "upper" and "lower" are employed by way of description and not limitation with respect to the upright orientation of the closure and/or container as illustrated in FIG. 2, for example. Directional words such as "axial" and "radial" are employed by way of description and not limitation with respect to the axis of container neck finish 24 and/or closure inner skirt 40 as appropriate.) A pair of ribs 58,60 extend upwardly from wall 54 adjacent to and contiguous with recess sidewalls 48,50 and adjacent to ledge 56. The radially outwardly facing surface 62 (FIGS. 2,4 and 6) of deck recess 46 is arcuate as viewed from the axial direction (FIG. 5) and has an arcuately extending latch element 64, such as a bead or channel (FIGS. 2, 5 and 6).

A dispensing opening 66 is provided in the bottom wall 68 of deck recess 46. Recess bottom wall 68 may be crowned, flat or of any other desired geometry, and may be at any desired angle to the axis of skirt 40. Dispensing opening 66 preferably is coaxial with inner skirt 40, although this need not necessarily be the case. The exemplary dispensing opening 66 is round, although other geometries can be employed In the exemplary embodiment of the disclosure, a dispensing valve 70 is mounted within dispensing opening 66. Provision of dispensing valve 70 is preferred, but not necessary in accordance with all aspects of the present disclosure. Dispensing valve 70, when provided, may be mounted in accordance with the disclosure of U.S. Pat. No. 6,672,487, U.S. application Ser. No. 10/874,036 and/or U.S. application Ser. No. 11/076,376. The inner periphery of dispensing opening 66 preferably is formed by a conical wall 72 that narrows axially downwardly from the upper surface of deck recess wall 68.

Lid 34 in the exemplary embodiment of the disclosure includes a base portion with a base wall 76 that is connected at one end to hinge 36. In the exemplary embodiment of the disclosure, lid 34 has laterally opposed side edges 78, 80, preferably straight side edges, that converge toward each other away from hinge 36 and are complimentary to sidewalls 48, 50 of deck recess 46. A tongue 82 extends substantially perpendicularly from lid base wall 76 at a position spaced from hinge 36. Tongue 82 is contoured for receipt over the edge of deck recess 46 spaced from hinge 36 between wall 62 and ribs 58, 60. Tongue 82 thus is arcuate as viewed from the axial direction, as best seen in FIG. 5. The spacing between ribs 58, 60 and wall 62 of base 32 preferably is such that tongue 82 is frictionally received between ribs 58, 60 and wall 62 to help prevent inadvertent opening of the lid. There preferably is an internal rib 84 on tongue 82 that is received by snap-fit over latch element 64 on wall 62 when the lid is closed additionally to prevent inadvertent opening of the lid. In the exemplary embodiment of the disclosure, lateral sidewalls 86, 88 extend along the lateral sides of lid 34 to strengthen the lid. Likewise, there preferably are laterally spaced gussets 90, 92 that extend between the inner surface of tongue 82 and the opposing inside surface of base wall 76 to strengthen tongue 82 against bending.

A spud 94 is formed on the inside surface of lid wall 76. Spud 94 includes an annular wall 96 that is contoured for close receipt within dispensing opening 66. The dimensions between hinge 36 and spud wall 96 on lid 34, and between hinge 36 and wall 72 surrounding dispensing opening 66 on base 32, preferably are such that the portion of wall 96 adjacent to hinge 36 engages the portion of wall 72 adjacent to hinge 36 and cams lid 34 away from hinge 36 as lid 34 is closed. This feature of the disclosure cooperates with the converging side edges of deck recess 46 and lid 34 to close any gap between the side edges and urge the lid toward thumb recess 52. In implementations of the disclosure that include a dispensing valve 70 (FIG. 4), annular wall 96 preferably is provided with a circumferential array of external axial channels 100. Channels 100 allow air to vent into the container after lid 34 is closed. For example, if the container is squeezed to dispense product and the lid immediately is closed, channels 100 allow air into the container and the container sidewalls can reassume their normal configurations. In implementations of the disclosure that include a dispensing valve 70, crossed ribs 102 within wall 96 engage the upper surface of the valve and prevent inadvertent outward opening of the valve when the lid is closed. In the closed position of lid 34 (FIG. 2), wall 96 preferably is disposed between the inner periphery of dispensing opening 66 and the outer periphery of valve 70, where a valve is provided, to prevent opening of the valve.

In use, container 26 preferably is filled with product before closure 22 is applied to the container. A foil seal disk 103 (FIG. 2) may be secured over the open end of container neck finish 24 before closure 22 is applied to the neck finish. Closure 22 must be removed and foil disk 103 removed before product can be dispensed. The foil disk, where employed, thus would provide an indication that the package has not previously been opened. To dispense product, lid 34 is opened by inserting a finger into thumb recess 52 and exerting upward force on the overlying end of lid 34. This upward force must overcome the force of snap-receipt of rib 84 on tongue 82 over latch element 64 on wall 62, and overcome the force of frictional engagement between ribs 58, 60 and the outer face of tongue 82. When these forces have been overcome and lid 34 has been opened, product can be dispensed through dispensing opening 66 of closure base 32.

After product has been dispensed, lid 34 may be pivoted toward the closed position. Wall 96 on lid 34 engages the back side of wall 72 surrounding dispensing opening 66—i.e., the side of the wall adjacent to hinge 36—to cam lid 34 toward thumb recess 52 as the lid is closed. This automatically aligns lid 34 with deck recess 46 and helps close any gaps that may otherwise exist between the lateral side edges of the lid and the opposing side edges of the deck recess. Tongue 82 is received between ribs 58, 60 and wall 62, and rib 84 is received by snap-fit over latch element 64 to complete closure of the lid. Channels 100 in wall 96 allow air to vent after the lid is closed. In the closed position of the lid, tongue 82 of lid 34 rests on ledge 56 of base 32, and support legs 104 (FIGS. 2 and 4-6) on lid 34 engage ledges 106 (FIGS. 2 and 5) on base 32 to support the lid in the closed position. Lid 34 is received in deck recess 46 such that the outer surface of the lid is at a desired elevation with respect to the outer surface of base deck 38. Orthogonally spaced external gussets 98 preferably are provided around wall 96 and extend along the underside of wall 76. Gussets 98 engage deck 38 around dispensing opening 66, as shown in FIG. 2. In the exemplary embodiment, the outer surface of lid 34 forms a substantially continuous slightly concave surface with the outer surface of deck 38, although other surface configuration can be employed. A logo and/or other indicia can be molded, printed or otherwise provided on the outer surface of lid 34 and/or deck 38.

There thus have been disclosed a dispensing closure, a closure and container package, and a method of making a dispensing closure that fully satisfy all of the objects and aims previously set forth. The disclosure has been presented in conjunction with an exemplary presently preferred embodiment, and a number of modifications and variations have been discussed. Other modifications and variations readily will suggest themselves to persons of ordinary skill in the art in view of the foregoing disclosure. The disclosure is intended to embrace all such modifications and variations as fall within the spirit and broad scope of the appended claims.

The invention claimed is:

1. A dispensing closure that includes:

a closure shell of one-piece integrally molded plastic construction that includes a base for securement to a container neck finish and a lid coupled by a hinge to said base, said base having a skirt, and a deck with a recess extending across said deck from a position adjacent to said hinge to a position opposite from said hinge, a dispensing opening in said deck recess, a radially outwardly facing wall disposed radially inwardly of said skirt, and a thumb recess in said skirt at a position opposite from said hinge and having a bottom wall, said lid having a base portion with a periphery for receipt in said deck recess and a tongue that extends substantially perpendicular to said base portion at an end of said base portion remote from said hinge wherein said tongue includes a lid latch element, and a base latch element in said radially outwardly facing wall in said thumb recess for engaging said lid latch element of said tongue on said lid to said base releasably to hold said lid in a closed position, wherein said base includes at least one rib to frictionally engage said tongue between said at least one rib and said radially outwardly facing wall of said deck in said closed position of said lid, and said base also includes a ledge provided between said thumb recess bottom wall and an edge of said deck recess and against which said tongue abuts in said closed position of said lid.

2. The dispensing closure set forth in claim 1 wherein said lid latch element comprises a bead on said tongue and said base latch element includes a channel in which said bead is received in said closed position.

3. A dispensing closure that includes:

a closure shell of one-piece integrally molded plastic construction that includes a base for securement to a container neck finish and a lid coupled by a hinge to said base, said base having a skirt, and a deck with a deck recess extending across said deck from a position adjacent to said hinge, a dispensing opening in said deck recess, a radially outwardly facing wall disposed radially inwardly of said skirt, and a thumb recess in said skirt that opens into said deck recess at a position opposite from said hinge and that has a bottom wall, said lid having a periphery for receipt in said deck recess in a closed position of said lid and a tongue at an edge of said lid remote from said hinge, wherein said tongue has a lid latch element and said deck has a base latch element in said radially outwardly facing wall in said thumb recess for snap-receipt of said lid latch element in said closed position of said lid, and at least one rib in said thumb recess for frictional engagement with said tongue between said at least one rib and said radially outwardly facing wall of said deck in said closed position of said lid, wherein said base includes a ledge provided between said thumb recess bottom wall and an edge of said deck recess and against which said tongue abuts in said closed position of said lid, wherein said lid has side edges that converge between said hinge and said tongue, and wherein said deck recess has side edges complimentary to said side edges of said lid.

4. The closure set forth in claim 3 wherein said at least one rib comprises a pair of said ribs in said thumb recess adjacent to said ledge for frictional engagement with said tongue.

5. The closure set forth in claim 3 wherein said side edges of said deck recess and said lid are straight side edges.

6. A dispensing closure that includes:

a closure shell of one-piece integrally molded plastic construction that includes a base for securement to a container neck finish and a lid coupled by a hinge to said base, said base having a deck and a skirt, a deck recess extending across said deck from a position adjacent to said hinge, a dispensing opening in said deck recess, and a thumb recess in said skirt that opens into said deck recess at a position opposite from said hinge, said lid having a periphery for receipt in said deck recess in a closed position of said lid and a tongue at an edge of said lid remote from said hinge, and at least one rib in said thumb recess for frictional engagement with said tongue between said at least one rib and said deck in said closed position of said lid, wherein said lid has side edges that converge between said hinge and said tongue, and wherein said deck recess has side edges complimentary to said side edges of said lid, wherein said lid has a wall for receipt in said dispensing opening in said closed position of said lid, and wherein dimensions between said hinge and said wall, and between said hinge and said dispensing opening, are such that said wall engages a periphery of said dispensing opening adjacent to said hinge as said lid is closed and cams said lid into alignment with said deck.

7. The closure set forth in claim 6 including a dispensing valve in said dispensing opening, and wherein said wall has at least one external channel to vent air when said lid is in said closed position.

8. The closure set forth in claim 7 wherein there are a circumferential array of said channels around said wall.

9. A dispensing closure that includes:

a closure shell of one-piece integrally molded plastic construction that includes a base for securement to a container neck finish and a lid coupled by a hinge to said base, said base having a deck with a dispensing opening and an elastomeric dispensing valve disposed within said dispensing opening, said lid having a wall disposed and contoured for receipt within said dispensing opening, and in contact with and between an outer periphery of said dispensing valve and an inner periphery of said dispensing opening, to prevent outward opening of said valve when said lid is closed, said wall having at least one external channel for venting air inward when said lid is closed, wherein said base has a recess extending across said deck from a position adjacent to said hinge to a position opposite from said hinge, said lid having a base portion with a periphery for receipt in said base recess and a tongue that extends substantially perpendicular to said base portion at an end of said base portion remote from said hinge, and a latch for engaging said tongue on said lid to said base releasably to hold said lid in said closed position.

10. The closure set forth in claim 9 wherein there are a circumferential array of said channels around said wall.

11. The closure set forth in claim 9 wherein said latch comprises a snap latch that includes an internal bead on said tongue and an external latch element in said thumb recess over which said internal bead is received in said closed position.

12. The closure set forth in claim 11 wherein said base includes a ledge in said thumb recess against which said tongue abuts in said closed position of said lid.

13. The closure set forth in claim 12 further comprising at least one rib adjacent to said ledge for frictional engagement with said tongue in said closed position of said lid to hold said bead in snap engagement with said latch element.

14. The closure set forth in claim 13 wherein said at least one rib comprises a pair of said ribs in said thumb recess adjacent to said ledge for frictional engagement with said tongue.

15. The closure set forth in claim 9 wherein said lid has side edges that converge between said hinge and said tongue, and said base recess has side edges complementary to said side edges of said lid.

16. The closure set forth in claim 15 wherein said side edges of said base recess and said lid are straight.

17. A package that includes a container having a neck finish and a dispensing closure on said neck finish, said dispensing closure including:

a closure shell of one-piece integrally molded plastic construction that includes a base for securement to a container neck finish and a lid coupled by a hinge to said base, said base having a skirt, and a deck with a recess extending across said deck from a position adjacent to said hinge to a position opposite from said hinge, a dispensing opening in said deck recess, a radially outwardly facing wall disposed radially inwardly of said skirt in said deck recess, and a thumb recess in said skirt at a position opposite from said hinge and having a bottom wall, said lid having a base portion with a periphery for receipt in said deck recess and a tongue that extends substantially perpendicular to said base portion at an end of said base portion remote from said hinge, wherein said tongue includes a lid latch element, and a base latch element in said radially outwardly facing wall in said thumb recess for engaging said lid latch element of said tongue on said lid to said base releasably to hold said lid in said closed position, wherein said lid has side edges that converge between said hinge and said tongue, and said deck recess has side edges complementary to said side edges of said lid, wherein said base includes at least one rib to frictionally engage said tongue between said at least one rib and said radially outwardly facing wall of said deck in said closed position of said lid, and wherein said base includes a ledge provided between said thumb recess bottom wall and an edge of said deck recess and against which said tongue abuts in said closed position of said lid.

18. The package set forth in claim 17 wherein said lid latch element comprises a bead on said tongue and said base latch element includes a channel in which said bead is received in said closed position.

19. The package set forth in claim 18 wherein said at least one rib also holds said bead in snap engagement with said latch element.

20. The package set forth in claim 19 wherein said at least one rib comprises a pair of said ribs in said thumb recess adjacent to said ledge for frictional engagement with said tongue.

21. The package set forth in claim 17 wherein said side edges of said deck recess and said lid are straight.

22. A package that includes a container having a neck finish and a dispensing closure on said neck finish, said dispensing closure including:

a closure shell of one-piece integrally molded plastic construction that includes a base secured to said container neck finish and a lid coupled by a hinge to said base, said base having a deck with a dispensing opening and an elastomeric dispensing valve disposed within said dispensing opening, said lid having a wall disposed and contoured for receipt within said dispensing opening, and in contact with and between an outer periphery of said dispensing valve and an inner periphery of said dispensing opening, to prevent outward opening of said valve when said lid is closed, said wall having at least one external channel for venting air inward when said lid is closed, wherein said base has a recess extending across said deck from a position adjacent to said hinge to a position opposite from said hinge, said lid having a base portion with a periphery for receipt in said recess and a tongue that extends substantially perpendicular to said base portion at an end of said base portion remote from said hinge, and a latch for engaging said tongue on said lid to said base releasably to hold said lid in said closed position.

23. The package set forth in claim 22 wherein there are a circumferential array of said channels around said wall.

24. The package set forth in claim 22 wherein said latch comprises a snap latch that includes an internal bead on said tongue and an external latch element in said thumb recess over which said internal bead is received in said closed position.

25. The package set forth in claim 24 wherein said base includes a ledge in said thumb recess against which said tongue abuts in said closed position of said lid.

26. The package set forth in claim 25 further comprising at least one rib adjacent to said ledge for frictional engagement with said tongue in said closed position of said lid to hold said bead in snap engagement with said latch element.

27. The package set forth in claim 26 wherein said at least one rib comprises a pair of said ribs in said thumb recess adjacent to said ledge for frictional engagement with said tongue.

28. The package set forth in claim 22 wherein said lid has side edges that converge between said hinge and said tongue, and said base recess has side edges complementary to said side edges of said lid.

29. The package set forth in claim 28 wherein said side edge of said base recess and said lid are straight.

30. The dispensing closure set forth in claim 1, wherein said lid has side edges that converge between said hinge and said tongue, and said deck recess has sidewalls complementary to said side edges of said lid, and wherein said at least one rib includes ribs extending upwardly from an axially facing bottom wall of said thumb recess along said sidewalls of said deck recess.

31. The dispensing closure set forth in claim 30 wherein said side edges of said deck recess and said lid are straight.

* * * * *

UNITED STATES PATENT AND TRADEMARK OFFICE

CERTIFICATE OF CORRECTION

PATENT NO. : 7,628,297 B2
APPLICATION NO. : 11/190443
DATED : December 8, 2009
INVENTOR(S) : Darin M. Pugne It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 551 days.

Signed and Sealed this

Second Day of November, 2010

David J. Kappos

David J. Kappos
*Director of the United States Patent and Trademark Office*